US005934773A

United States Patent [19]

Ferrell

[11] Patent Number: 5,934,773

[45] Date of Patent: Aug. 10, 1999

[54] HUMIDIFIER DEVICE

[76] Inventor: Joseph C. Ferrell, 948 Wood Dale Rd., Morristown, Tenn. 37814

[21] Appl. No.: 08/887,970

[22] Filed: Jul. 3, 1997

[51] Int. Cl.[6] ..... A24F 25/00

[52] U.S. Cl. ..... 312/31.1; 312/31; 206/204; 206/205

[58] Field of Search ..... 312/31, 31.1, 31.01; 206/242, 213.1, 204, 205

[56] References Cited

U.S. PATENT DOCUMENTS

| | | | |
|---|---|---|---|
| 290,140 | 12/1883 | Swift | 206/205 X |
| 1,059,693 | 4/1913 | Woods . | |
| 1,507,933 | 9/1924 | Roblin | 312/31.1 X |
| 1,938,384 | 12/1933 | Hauch . | |
| 1,999,554 | 4/1935 | Zucker . | |
| 2,300,041 | 10/1942 | Bradley | 312/31 X |
| 2,740,683 | 4/1956 | June | 312/31 |
| 2,860,023 | 11/1958 | Herdlitchka . | |
| 3,431,038 | 3/1969 | Berliner . | |
| 3,722,188 | 3/1973 | Cullen | 206/205 X |
| 4,201,296 | 5/1980 | Hrabik . | |
| 4,428,892 | 1/1984 | Berliner . | |
| 4,638,909 | 1/1987 | Ford | 206/205 X |
| 4,934,524 | 6/1990 | St. Charles . | |
| 4,973,448 | 11/1990 | Carlson et al. . | |
| 5,037,459 | 8/1991 | Spruill et al. | 206/204 X |
| 5,607,051 | 3/1997 | Espinosa . | |
| 5,667,863 | 9/1997 | Cullen et al. | 206/204 X |
| 5,803,247 | 9/1998 | Holmes et al. | 206/213.1 |

FOREIGN PATENT DOCUMENTS

| | | | |
|---|---|---|---|
| 936678 | 7/1948 | France . | |
| 85821 | 9/1965 | France | 206/204 |
| 2665890 | 2/1992 | France | 206/204 |
| 1536056 | 11/1969 | Germany | 206/204 |
| 216213 | 5/1924 | United Kingdom . | |
| 233259 | 5/1925 | United Kingdom . | |

*Primary Examiner*—Peter M. Cuomo
*Assistant Examiner*—Hanh V. Tran
*Attorney, Agent, or Firm*—Richard C. Litman

[57] ABSTRACT

A humidifier device including at least two housings, each housing containing an absorbent material. Each housing is designed as a stamped or molded cup-shaped member having rounded corners and a flanged edge, and a plurality of apertures. A flat, rectangular member is attached to the flanged edge, thereby creating a cavity between the flat, rectangular member and the cup-shaped member. The absorbent material is located within the cavity and is soaked with an evaporative solution for imparting moisture into the storage case by evaporation through the apertures in the housing. The humidifier device may be replenished by pouring solution through the apertures on the housings, or by immersing humidifier device in a bath of solution, thereby allowing the absorbent material to become replenished with solution. The housings are each provided with a magnet attached to the flat, rectangular member which can be used to mount the housing to a second magnet mounted on the interior of the storage case. In the preferred embodiment the housings are detachably joined by a frangible member. The frangible member allows the user to use the two housings as a single unit or as two separate units, depending on the humidity needs of any particular storage case. The humidifier device may include two, three, four, or more housings detachably joined to each other by frangible members.

7 Claims, 2 Drawing Sheets

HUMIDIFIER DEVICE

BACKGROUND OF THE INVENTION

1. Field of the Invention

The present invention relates generally to devices used to control humidity, and particularly well suited for humidifying tobacco product storage cases. More specifically, the present invention is a humidifier device designed to be easily modified to suit the particular needs of a variety of storage cases and capable of being easily replenished or replaced.

2. Description of the Related Art

Humidifying devices have long been used to control the humidity level within an enclosed environment. One specific area in which humidifying devices have been successfully utilized is in storage cases for storing various tobacco products, food items, musical instruments, or other items that benefit from a controlled environment during long periods of storage. Many attempts have been made to design a humidifying device that is inexpensive to manufacture, easy to maintain, and capable of effectively humidifying an enclosed storage case. No other humidifying device has achieved the same level of success as the present invention.

Consequently, there is a need for a device to control humidity within a storage case that is simple in design and, therefore, relatively inexpensive to manufacture and maintain. The humidifying device should include a plurality of discrete units detachably connected to one another, thereby allowing the user to select the proper number of units necessary to control the humidity level in that particular storage case. The device must be capable of being easily replenished or replaced as needed. Furthermore, the device should be easily detachably mounted to the interior of the storage case without requiring the case to be modified or damaged in order to mount the device.

The following patent publications are examples of related inventions. U.S. Pat. No. 1,059,693, issued on Apr. 22, 1913, to Edwin S. Woods describes a humidor having a refillable reservoir with several pads of absorbent material having removable covers attached thereto and wicks that extend from the reservoir to the pads to supply the pads with fluid. The patent to Woods describes a bulky and relatively complex humidifier structure that is, therefore, relatively expensive to manufacture and maintain.

U.S. Pat. No. 1,938,384, issued on Dec. 5, 1933, to Wendell M. Hauch describes a humidor having a removable moistening element container and a mechanism for controlling the amount of moisture released into the humidor. The patent to Hauch describes a humidor containing a humidity control device which occupies a substantial portion of the humidor and is relatively complex in design.

U.S. Pat. No. 1,999,554, issued on Apr. 30, 1935, to Richard D. Zucker describes a humidor having a detachable cover housing a container for a moistening element. The container has one or more passages leading from the interior of the container to the interior of the humidor and a mechanism for selectively opening or closing the passages, thereby controlling the amount of moisture released into the humidor. The patent to Zucker describes a humidor containing a humidity control device which occupies a substantial portion of the humidor and is relatively expensive to manufacture and maintain.

U.S. Pat. No. 2,860,023, issued on Nov. 11, 1958, to James W. Herdlitchka describes a cigar box humidifier integrated into an auxiliary transparent cover that attaches to the permanently hinged cover of a humidor. The transparent cover is provided with a sponge retaining cup which is lined with moisture releasing holes. The patent to Herdlitchka describes a humidifier of relatively complex design which requires that the cigar box be damaged (see pins 31 in FIG. 1) in order to mount the device.

U.S. Pat. No. 3,431,038, issued on Mar. 4, 1969, to Martin Berliner describes a unitary humidifier to be placed in humidors or other similar containers. The humidifier has a water reservoir in communication with a chamber of tightly packed fibrous, water-absorbent material with an adjustable opening to the surrounding area to emit moisture laden air with varying amounts of moisture. The patent to Berliner describes a relatively complex humidifier structure that is, therefore, relatively expensive to manufacture and maintain.

U.S. Pat. No. 4,201,296, issued on May 6, 1980, to Heinrich Hrabik describes a preservative for film including a capsule housing a tablet containing compacted camphor powder. The capsule is mounted within an aperture in the wall of a film magazine. The capsules are manufactured as a plurality of discrete units on a perforated strip of base sheet material. The patent to Hrabik requires the wall of the film magazine to either be modified to include an aperture or manufactured with an aperture which may compromise the integrity of the enclosed environment within the magazine.

U.S. Pat. No. 4,428,892, issued on Jan. 31, 1984, to Martin Berliner describes a humidifier device including a housing detachably secured to the interior of a musical instrument case, the housing having a refillable reservoir that feeds a surrounding absorbent ring. The patent to Berliner describes a relatively complex humidifier structure that is, therefore, relatively expensive to manufacture and maintain.

U.S. Pat. No. 4,934,524, issued on Jun. 19, 1990, to Frank K. St. Charles describes a storage package for cigarettes including a receptacle having a moisture control vehicle therein. The moisture control vehicle is treated with a saturated salt solution having a water activity level preselected to the water activity level of the cigarettes to maintain moisture equilibrium over an extended period of time. The patent to St. Charles describes a humidifier device which is significantly different in structure from the present invention.

U.S. Pat. No. 4,973,448, issued on Nov. 27, 1990, to Richard R. Carlson et al. describes a powdered composition enclosed within a sealed envelope which is formed of a sheet material impermeable to the powdered composition, but which is porous to the released vapor phase corrosion inhibiting compound released from the powdered composition. The sealed envelopes are manufactured in large sheets of individual envelopes having perforations in between the individual envelopes. The patent to Carlson et al. does not describe a humidifier device capable of being replenished.

U.S. Pat. No. 5,607,051, issued on Mar. 4, 1997, to Jorge L. Espinosa describes a cigar humidor having two separate storage compartments; one compartment is provided with a humidifier which is attached to the underside of a lid. The patent to Espinosa does not describe a humidifier device detachably mounted to the humidor.

United Kingdom Patent Number 216,213, published on May 23, 1924, describes a device having a pad or block of moisture absorbent material detachably fastened to the interior surface of the lid of a bottle or other container. The United Kingdom Patent Number 216,213 describes a device which is significantly different in structure from the present invention.

United Kingdom Patent Number 233,259, published on May 7, 1925, describes a device detachably mounted under the lid of a glass bottle which is used to absorb any moisture in the bottle. The United Kingdom Patent Number 233,259 describes a device which is significantly different in structure from the present invention.

French Patent Number 936,678, published on Jul. 27, 1948, describes a humidifying pad having a plurality of mounting holes. The French Patent Number 936,678 describes a device which is significantly different in structure from the present invention.

None of the above inventions and patents, taken either singularly or in combination, is seen to describe the instant invention as claimed. Thus a humidifier device solving the aforementioned problems is desired.

SUMMARY OF THE INVENTION

A humidifier device of the present invention is particularly well suited for humidifying tobacco product storage cases, because the device is designed to be easily modified to suit the particular needs of a variety of storage cases and capable of being easily replenished or replaced.

The humidifier device includes at least two housings, each housing containing an absorbent material. Each housing is designed as a stamped or molded cup-shaped member having rounded corners and a flanged edge, and a plurality of apertures. A flat, rectangular member is attached to the flanged edge, thereby creating a cavity between the flat, rectangular member and the cup-shaped member.

An absorbent material is located within the cavity and is soaked with an evaporative solution for imparting moisture into the storage case by evaporation through the apertures in the housing. The humidifier device may be replenished by pouring solution through the apertures on the housings, or by immersing the humidifier device in a bath of solution, thereby allowing the absorbent material to become replenished with solution. The housings are each provided with a magnet attached to the flat, rectangular member which can be used to mount the housing to a second magnet mounted on the interior of the storage case.

In the preferred embodiment the housings are detachably joined by a frangible member. The frangible member allows the user to use the two housings as a single unit or as two separate units, depending on the humidity needs of any particular storage case. The humidifier device may include two, three, four, or more housings detachably joined to each other by frangible members.

Accordingly, it is a principal object of the invention to provide a device to control humidity within a storage case that is simple in design and, therefore, relatively inexpensive to manufacture and maintain.

It is another object of the invention to provide a device to control humidity within a storage case that includes a plurality of discrete units detachably connected to one another, thereby allowing the user to select the proper number of units necessary to control the humidity level in that particular storage case.

It is a further object of the invention to provide a device to control humidity within a storage case that can be easily replenished or replaced as needed.

Still another object of the invention is to provide a device to control humidity within a storage case that can be easily detachably mounted to the interior of the storage case without requiring the case to be modified or damaged in order to mount the device.

It is an object of the invention to provide improved elements and arrangements thereof in a humidifier device for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
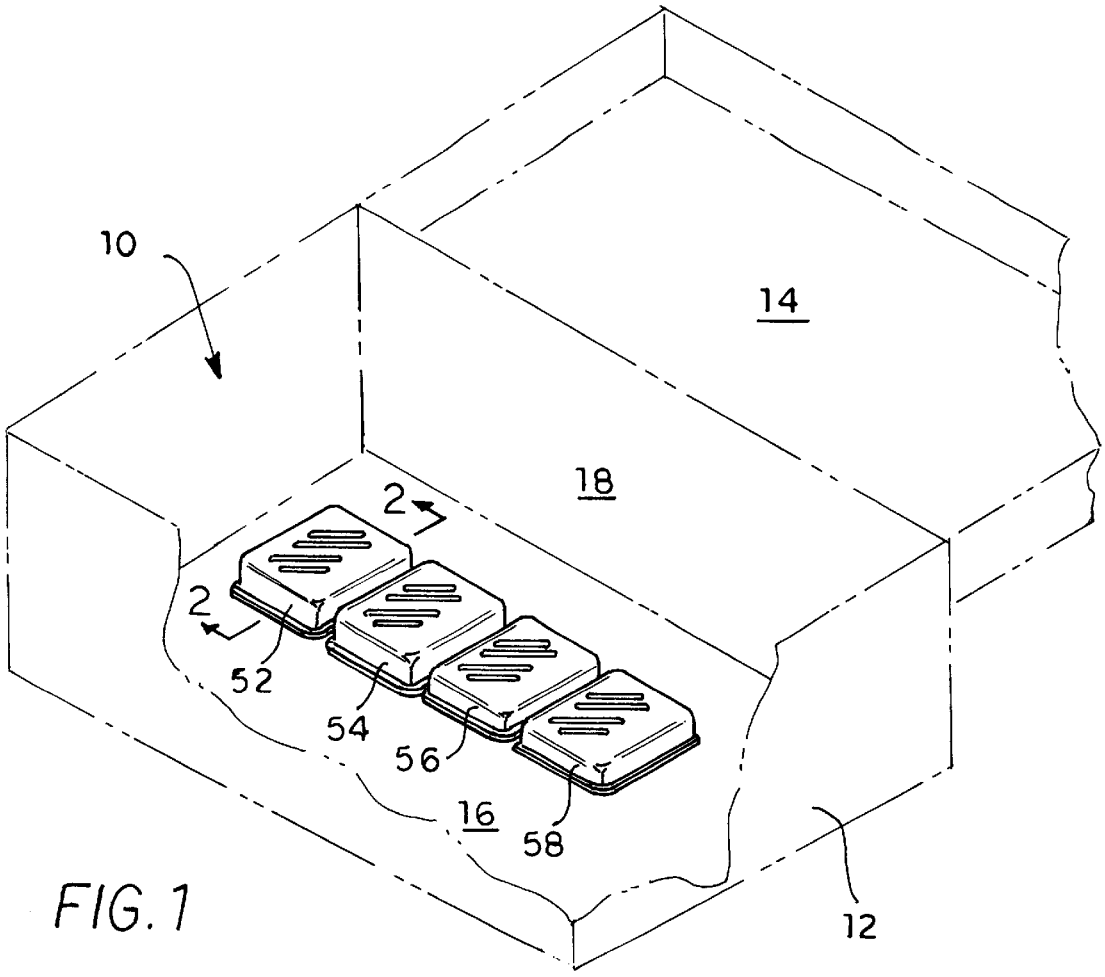
FIG. 1 is an environmental, perspective view of a humidifier device according to the present invention mounted to the bottom of a storage case.

Referring to FIG. 1, a humidifying device 10 according to a preferred embodiment of the present invention includes four housings, 52, 54, 56, and 58, that contain moisture absorbent material and are detachably mounted to the interior of a storage case 12, such as a humidor. The humidifying device 10 moistens the air within the storage case 12 in order to control the humidity level therein. The humidifying device 10 may be detachably mounted to any of the side walls of the humidor 12, such as the rear wall 18, to the bottom wall 16 (as shown in FIGS. 1 and 2), or to the lid 14 of the humidor.

Figure 2:
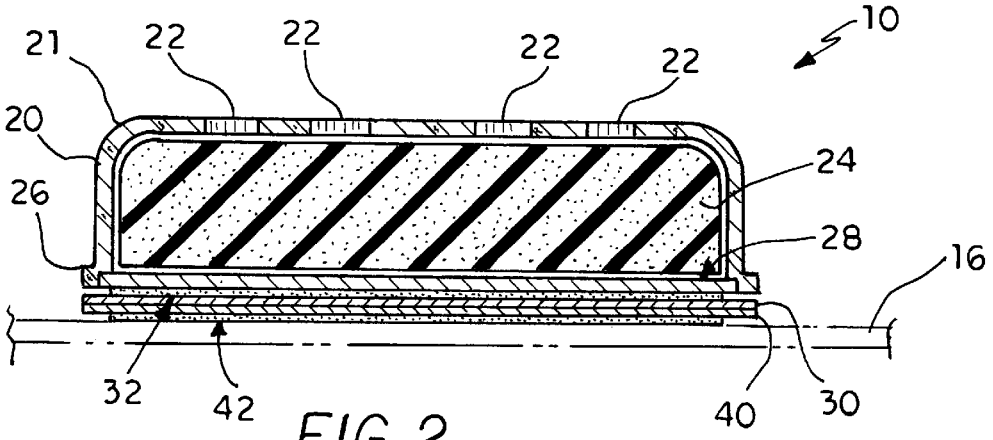
FIG. 2 is an enlarged cross-sectional view, along lines 2—2 in FIG. 1, of a humidifier device mounted to the bottom of a storage case using a pair of magnets.
Figure 3:
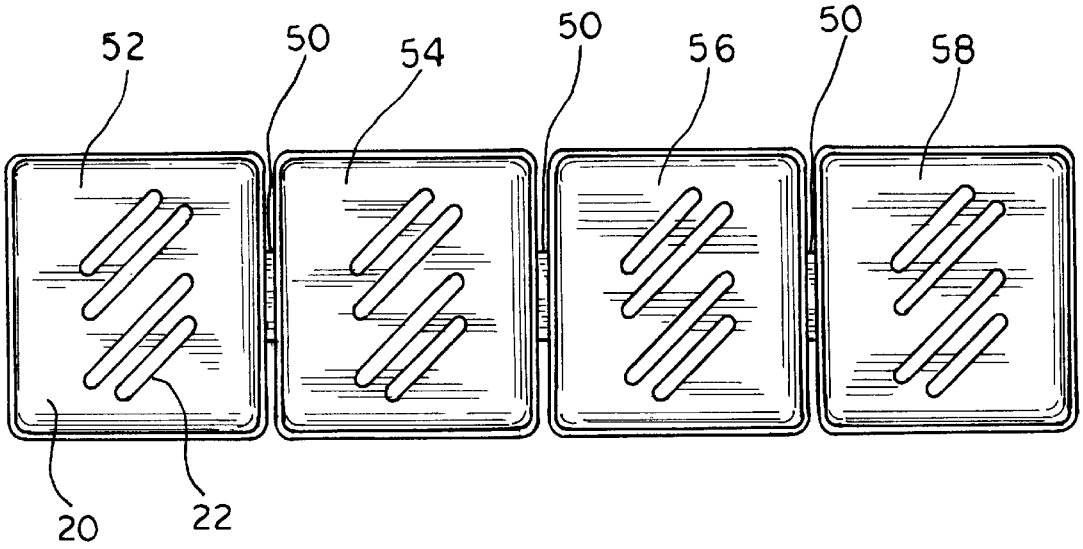
FIG. 3 is a top view of a humidifier device according to the present invention showing the frangible connectors.

FIG. 2 shows an enlarged cross-sectional view, along lines 2—2 in FIG. 1, of the humidifier device 10 mounted to the bottom wall 16 of a storage case 12 using a pair of magnets, 30 and 40. The humidifier device 10 of the present invention includes at least two housings 20, each housing containing an absorbent material 24. Each housing 20 is designed as a stamped or molded cup-shaped member 21 having rounded corners, a flanged edge 26, and a plurality of apertures 22. A flat, rectangular member 28 is attached to the flanged edge 26, thereby creating a cavity between the flat, rectangular member 28 and the cup-shaped member 21. Each housing 20 is preferably approximately 3"×2¾"×¾" in size. The housing 20 is preferably manufactured from plastic material for ease of manufacturing, although other materials may be used to achieve similar structural results.

The absorbent material 24 is located within the cavity and is soaked with an evaporative solution for imparting moisture into the interior of the storage case 12 by evaporation through the apertures 22 in the housing 20. The evaporative solution is made from distilled water and chemical components which are well known in the art. The humidifier device 10 may be replenished by pouring the solution through the apertures on the housings, or by immersing humidifier device in a bath of solution, thereby allowing the absorbent material to become replenished with solution. Each housing 20 has several slot-shaped apertures 22 of various sizes.

The housing 20 is provided with a magnet 30 attached to the flat, rectangular member which can be used to mount the housing 20 to a magnetically attracted second magnet 40 mounted on the interior of the storage case 12. Magnet 30 could be permanently attached to the flat, rectangular member 28 or could act as the flat, rectangular member 28. In the preferred embodiment magnet 30 is attached to housing 20 by a piece of double sided tape 32 and magnet 40 is attached to the storage case 12 by a piece of double-sided tape 42. The magnets are preferably 2"×2"×0.030" in size. Alternatively, hook and loop fasteners (not shown), other adhesives, or similar mounting device can be used in place of the magnets 30 and 40. Similar to the magnets 30 and 40, the hook and loop fasteners can be attached to the housing 20 and to the storage case 12 by double-sided pieces of tape, 32 and 42.

In the preferred embodiment the housings, 52, 54, 56, and 58, are detachably joined by a frangible member 50. The frangible member 50 is preferably made of a plastic material that is broken by simply bending the frangible member 50. The frangible member 50 allows the user to use the housings, 52, 54, 56, and 58, as a single unit or as separate units, depending on the humidity needs of any particular storage case 12. The humidifier device 10 may be mounted within a storage case 12 as a group of two, three, four, or more housings. The housings 20 may be manufactured as a row or as a sheet of several rows of housings 20 all joined together by frangible members 50. The frangible member 50 allows the users to customize the humidifier device 10 by selecting how many housings 20 are needed for a particular size storage case 12 and a particular type and number of items being stored within that storage case 12.

The humidifier device 10 of the present invention may be manufactured and distributed in combination with a storage case 12 and distributed as a humidor. The resulting humidor of the present invention is a storage case 12 in which the enclosed air is maintained at a predetermined humidity. The resulting humidor is ideal for storing various tobacco products or other items, such as food items or musical instruments, that benefit from a controlled environment during long periods of storage.

The humidifier device 10 may also be manufactured and distributed in a kit form where the kit includes two or more housings 20 containing absorbent material 24 and joined by frangible members 50, a pair of mounting magnets, 30 and 40, for each housing 20, and two pieces of double-sided tape, 32 and 42, for attaching the magnets, 30 and 40, to the housings 20 and to the storage case 12. The kit may be sold with magnet 30 attached to the housing 20 by tape 32, or with the magnet 30, the housing 20 and the tape 32 being separate. Similarly, the kit can be sold with magnet 40 attached to the piece of tape 42, or with the magnet 40 and the tape 42 being separate. Any exposed adhesive side of tape should be covered by a conventional removable piece of paper that protects the adhesive material and can be peeled from the tape before the tape is applied to a surface.

Note that the present invention 10 could be used to absorb moisture within the storage case 12 by using an absorbent material such as a desiccant, which is capable of absorbing moisture from the surrounding air.

It is to be understood that the present invention is not limited to the embodiments described above, but encompasses any and all embodiments within the scope of the following claims.

I claim:

1. A humidifying device for use within a case having an interior surface, said device comprising:

a first cupped housing having a first flanged edge, said first housing defining a first cavity and at least one aperture passing completely through said first housing;

a first absorbent member contained within said first cavity of said first housing, said first absorbent member containing a moisture imparting evaporative solution;

a first flat member attached to said first flanged edge such that said first cavity is completely enclosed;

first mounting means for detachably mounting said first housing to the interior surface of the case;

at least a second cupped housing having a second flanged edge, said second housing defining a second cavity and at least one aperture passing completely through said second housing;

a second absorbent member contained within said second cavity of said second housing, said second absorbent member containing a moisture imparting evaporative solution;

a second flat member attached to said second flanged edge such that said second cavity is completely enclosed;

second mounting means for detachably mounting said second housing to the interior surface of the case; and a frangible member connecting said first housing to said second housing alone said first flanged edge and said second flanged edge for detachably connecting said first housing to said second housing.

2. The device as defined in claim 1 wherein said first mounting means comprise:

a first magnet attached to said first housing; and a second magnet attachable to the interior surface of the case, said second magnet is adjacent to and magnetically attracted to said first magnet.

3. The device as defined in claim 1 wherein said first housing has a plurality of apertures.

4. The device as defined in claim 3 wherein said plurality of apertures are of various sizes.

5. A humidor comprising:

a case defining an enclosed space, said case having a lid and an interior surface;

a humidifying device comprising:

a first cupped housing having a first flanged edge, said first housing defining a first cavity and at least one aperture passing completely through said first housing;

a first absorbent member contained within said first cavity of said first housing, said first absorbent member containing a moisture imparting evaporative solution;

a first flat member attached to said first flanged edge such that said first cavity is completely enclosed;

first mounting means for detachably mounting said first housing to the interior surface of the case;

at least a second cupped housing having a second flanged edge, said second housing defining a second cavity and at least one aperture passing completely through said second housing;

a second absorbent member contained within said second cavity of said second housing, said second absorbent member containing a moisture imparting evaporative solution;

a second flat member attached to said second flanged edge such that said second cavity is completely enclosed;

second mounting means for detachably mounting said second housing to the interior surface of the case; and a frangible member connecting said first housing to said second housing along said first flanged edge and said second flanged edge for detachably connecting said first housing to said second housing.

6. The humidor as defined in claim 5 wherein said first housing has a plurality of apertures.

7. The humidor as defined in claim 6 wherein said plurality of apertures are of various sizes.

* * * * *